US006009700A

United States Patent [19]

Wassenhoven et al.

[11] Patent Number: 6,009,700

[45] Date of Patent: Jan. 4, 2000

[54] METHOD AND DEVICE FOR OPERATING AN OPEN-END SPINNING MACHINE

[75] Inventors: Heinz-Georg Wassenhoven, Mönchengladbach; Willi Wassen, Schwalmatal; Maximilian Preutenborbeck; Claus-Dieter Landolt, both of Mönchengladbach; John Cundill, Rösrath-Kleineichen, all of Germany

[73] Assignee: W. Schlafhorst AG & Co., Moenchengladbach, Germany

[21] Appl. No.: 09/208,690

[22] Filed: Dec. 10, 1998

[30] Foreign Application Priority Data

Dec. 11, 1997 [DE] Germany ..... 197 55 060

[51] Int. Cl.[7] ..... D10H 13/26

[52] U.S. Cl. ..... 57/263; 57/264; 57/414

[58] Field of Search ..... 57/263, 264, 414, 57/406, 415, 417

[56] References Cited

U.S. PATENT DOCUMENTS 4,150,530 4/1979 Derichs ..... 57/264
5,509,261 4/1996 Wassenhoven et al. ..... 57/264
5,509,262 4/1996 Stahlecker ..... 57/264

FOREIGN PATENT DOCUMENTS 25 14 734 A1 10/1976 Germany .
26 34 070 A1 2/1978 Germany .
41 17 175 A1 11/1992 Germany .

*Primary Examiner*—William Stryjewski
*Attorney, Agent, or Firm*—Kennedy Covington Lobdell & Hickman, LLP

[57] ABSTRACT

In an open-end spinning machine (1) with a plurality of open-end spinning devices (3), each having a spinning rotor (15) whose rotor shaft (26) is seated in the bearing wedge of an axial thrust-free support disk bearing (27) and is positioned by a magnetic bearing (29), and a service unit (10), which automatically services the spinning devices, a sensor device (41) is provided on the service unit (10), which is connected to the control device (18) of the service unit (10) and checks an identification marker (34) applied to each spinning rotor (15). The control device (18) actuates a yarn piecing operation by the service unit only upon detection of an identification marker (34) identifying the spinning rotor (15) to be compatible with the associated spinning device.

11 Claims, 3 Drawing Sheets

METHOD AND DEVICE FOR OPERATING AN OPEN-END SPINNING MACHINE

FIELD OF THE INVENTION

The present invention relates to a method for operating an open-end spinning machine with a plurality of open-end spinning devices and a service unit, which automatically services the spinning devices, wherein the open-end spinning devices each have a spinning rotor, whose rotor shaft is seated in the bearing wedge of an axial thrust-free support disk bearing and is positioned by means of a magnetic bearing. The invention further relates to a device for executing the method.

BACKGROUND OF THE INVENTION

In open-end spinning machines, it has been long known to seat the rotor shaft of the spinning rotor in the bearing wedge of a support disk bearing having two pairs of support rollers, since such bearings make possible very high rpm and have a long service life.

With support disk bearings of this type, the axes of the pairs of support rollers are customarily arranged slightly crossed, so that during operation an axial force component acts on the rotor shaft. This axial force component maintains the rotor shaft securely in contact with a mechanical axial bearing arranged at the end of the rotor shaft.

Although such rotor bearing as above described, and for example more fully disclosed in German Patent Publication DE 25 14 734 C2, has proven itself in actual use and large numbers thereof are in use, this type of rotor seating also has some disadvantages.

Not only is the spinning rotor limited to a structurally predetermined direction of rotation because of the crossed arrangement of the pairs of support disks, but the crossed arrangement of the pairs of support disks also results in increased friction in the area of the support disks/rotor shaft with the result, that the bearing faces of the support disks become heated. The coatings of the support disks are greatly stressed by this frictional heat, but additional energy is also required for overcoming this friction.

Furthermore, with this type of seating of the rotor shaft, the mechanical axial bearing arranged at the end of the rotor shaft is highly stressed, which has a negative effect on the service life of this bearing.

Although it has been possible to quite clearly improve the wear resistance of such axial bearings by the installation of a wear- resistant ceramic pin (as disclosed in German Patent Publication DE 41 17 174 A1), it continues to be necessary to sufficiently lubricate these bearings regularly. However, in spinning mills such bearings lubricated with oil are not without problems because of the almost unavoidable oil leaks.

A rotor bearing is known from the subsequently published German Patent Publication DE 197 29 191.0, which avoids the above described disadvantages. Although with this type of bearing, the rotor shaft of the spinning rotor is also seated in the bearing wedge of a support disk bearing, the axes of the two pairs of support disks are not crossed, but are arranged parallel with the rotor shaft and with one another. Thus, little or no axial forces act on the rotor shaft of the spinning rotor during operation. Instead, the axial positioning of the spinning rotor in the bearing wedge of the support disk bearing is provided by means of a magnetic bearing arranged at the end of the rotor shaft and having radially arranged magnetic bearing components. The special structural design of this magnetic bearing assures that the spinning rotor remains securely positioned even at rpm which are clearly greater than 100,000 revolutions per minute.

Because of its reduced energy requirements and increased service life, the support disk bearing in accordance with German Patent Publication DE 197 29 191.0 has indisputable advantages over support disk bearings with crossed pairs of support disks and mechanical axial bearings. Nevertheless, problems can arise when these support disk bearings are used, particularly in spinning mills in which open-end spinning devices with mechanical axial bearings as well as open-end spinning devices with magnetic rotor positioning are used. That is, the accidental installation of a rotor designed for a mechanical bearing in an axial thrust-free open-end spinning device with magnetic positioning of the spinning rotor can cause considerable damage to the respective spinning device because of the lack of an axial fixation of the spinning rotor which would then occur. In addition, such a spinning rotor installed in the wrong spinning device, which therefore is not fixed in its axial direction, represents a not inconsiderable risk of an accident, especially because of its high operating rpm.

A sufficient and dependable fixation of the rotor shaft in the bearing wedge of the support disk bearing, particularly when operating at high rpm, is only assured when the bearing components involved, i.e. the bearing component which has the permanent magnets and is arranged stationarily on the spinning device and the bearing component rotating with the bearing shaft, are exactly matched to each other. Thus, even small deviations of the bearing components can result in considerable damage.

SUMMARY OF THE INVENTION

Based on the above discussed prior art, it is an object of the present invention to develop a method and a device which assures a dependable operation of open-end spinning machines with axial thrust-free support disk bearings.

In accordance with the present invention, this object is attained by a method for operating an open-end spinning machine having a plurality of open-end spinning devices and a service unit for automatically servicing the spinning devices. The service unit has a device for piecing yams being spun at the spinning devices and a control device for controlling actuation of the piecing device. Each of the open-end spinning devices has a spinning rotor, a rotor shaft affixed to the rotor, an axial thrust-free support disk bearing forming a bearing wedge in which the rotor shaft is supported, and a magnetic bearing for positioning the rotor shaft. According to the present invention, an identification marker (preferably in the form of a security marking) is provided on each spinning rotor, and the service unit is equipped with a sensor device connected with the control device of the service unit for detecting the identification markers of the spinning rotors. Thus, the identification marker on a spinning rotor is detected by the sensor device prior to a yarn piecing operation at the associated spinning device and a yarn piecing operation is actuated by the service unit only upon detection that the identification marker identifies the spinning rotor to be compatible with the associated spinning device, thereby to prevent the yam piecing operation so as to prevent risk of damage or injury from use of improper spinning rotors.

The method in accordance with the invention assures that only appropriately embodied spinning rotors can be operated in an open-end spinning device having an axial thrust-free support disk bearing designed for the magnetic positioning of the spinning rotor. That is, with such a spinning device, the accidental use of a spinning rotor designed for an open-end spinning device with crossed pairs of support disks and a mechanical axial bearing is dependably prevented by means of the method in accordance with the invention by which the installation of a spinning rotor whose rotating bearing component does not meet the requirements is dependably detected.

In this connection, it is possible on the basis of the installed sizes of the spinning rotors to install such a wrong spinning rotor in a spinning device but, because of the lack of an identification marker, such a spinning rotor is immediately recognized by the sensor device connected to the control device of the service unit and determined to be questionable because of technological safety considerations. In such a case, the control device of the service unit immediately stops the piecing process.

In a preferred embodiment, an information carrier is used as the identification marker, which can contain a multitude of data, for example the type, the size, the model year, etc. of the spinning rotor. The data, which can be picked up by the sensor device of the service unit, are compared and evaluated in the control device of the service unit with preset data stored in an associated memory unit. Not only are spinning rotors, which are questionable because of technological safety considerations, identified by means of the comparison of the data, but it is also possible by means of such a comparison to assure, for example in connection with a batch change, that the spinning rotors which are correct for the respective yam batch according to considerations of spinning technology are always used. Thus, because of missing or incorrect data on the information carrier it is possible to detect that a spinning rotor is a spinning means which is questionable for technological safety considerations or is incorrect for reasons of spinning technology which, as already mentioned above, leads to the immediate stopping of the respective spinning station.

The identification marker on the spinning rotor is preferably in the area of its spinning cup, and unequivocally identifies it as a magnetically positionable spinning rotor which is structurally exactly matched to the stationary bearing component. This identification marker is detected by a sensor device at the service unit which, for example, may be advantageously arranged at the cleaning head of the service unit, and is decoded in the associated control device. Thus, a comparison between the spinning rotor data stored in a memory unit and the data of the identification marker is performed in the control device of the service unit. Piecing is attempted only if these data match. Data which cannot be identified, are missing, or are in error automatically lead to an immediate stop of the respective spinning station.

An electronic information carrier is preferably used as the identification marker. In such case, the electronic information carrier can contain a multitude of data, for example regarding the type of the spinning rotor, its size, its coating, its model year, etc. In a preferred embodiment, the electronic information carrier is designed as a so-called transponder. Such a transponder is a commercially available, passive electronic chip which, when needed, can be actuated via a transmitting and receiving device arranged on the service unit, and can then be read.

An alternative embodiment of an information carrier is a bar code. In such case, the sensor device on the service unit is designed as a scanner.

In a further aspect of the invention, it is also possible to arrange an identification marker on the spinning rotor which can be inductively detected by the sensor device.

Regardless of the type of information carrier arranged on the spinning rotor, it is assured in every case that a wrong spinning rotor, i.e. a spinning rotor which could lead to an endangerment of the spinning machine or the operators, is immediately recognized by the sensor device with the result, that the respective spinning device is stopped.

Further details, features and advantages of the invention will be described and understood from the description below of an exemplary embodiment represented by means of the accompanying drawings.

DETAILED DESCRIPTION OF THE PREFERRED EMBODIMENT

Figure 1:
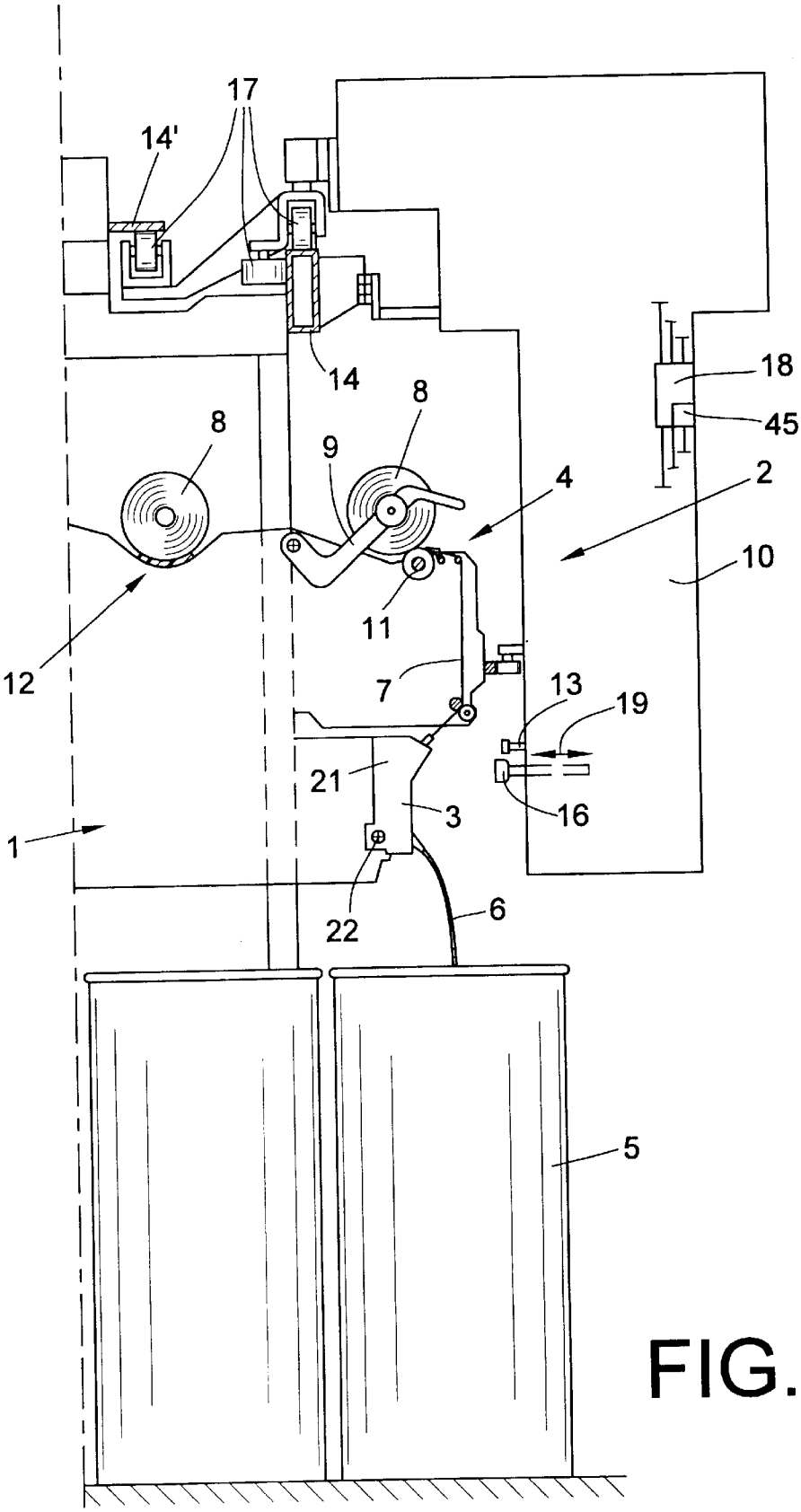
FIG. 1 is a schematic side view, partially in cross-section, of a multi-station open-end rotor spinning machine having a service unit which automatically services the work stations, showing the service unit positioned at one work station.

Referring now to the accompanying drawings and initially to FIG. 1, a work station 2 of an open-end rotor spinning machine, identified as a whole by the reference numeral 1, is represented in a side view.

The spinning machine has a plurality of such work stations 2 aligned with one another along the length of the machine, each of the work stations 2 having an open-end spinning device 3 and a winding device 4. A sliver 6, delivered from spinning cans 5, is spun into a yarn 7 in the spinning device 3 in a known manner and is subsequently wound into a cheese 8 in the winding device 4. The cheese 8 is seated in a creel 9 in the winding device 4 and is driven via a friction roller 11 during the winding travel.

The removal of the finished cheeses 8 takes place by means of a cheese transport device 12 extending over the length of the machine.

The work stations 2 of the open-end spinning rotor machine 1 are serviced by an automatically operating service unit 10, which is supported on rails 14, 14' by its undercarriage 17. The rails 14, 14' preferably extend in the superstructure of the open-end spinning machine 1. It is known from numerous references and therefore not shown in greater detail that the service unit 10 has a plurality of manipulating devices for piecing or changing the cheese.

Among other things, such a service unit 10 has an unlocking lever 13, by means of which the open-end spinning device 3 can be opened and closed as needed, and a cleaning head 16 for cleaning the spinning rotors 15. Cleaning of the spinning rotors is periodically performed preventively as well as after a yarn break.

The cleaning head 16 can be extended by means of a drive 19 in the direction of the spinning housing 20 of the open-end spinning device 3. Both the unlocking lever 13 and the cleaning head 16 are standard components, known per se, of such service units 10.

In addition, the service unit 10 is equipped with its own control device 18, which is connected, for example via a machine bus, to a central control unit, not represented, of the open-end rotor spinning machine 1.

Figure 2:
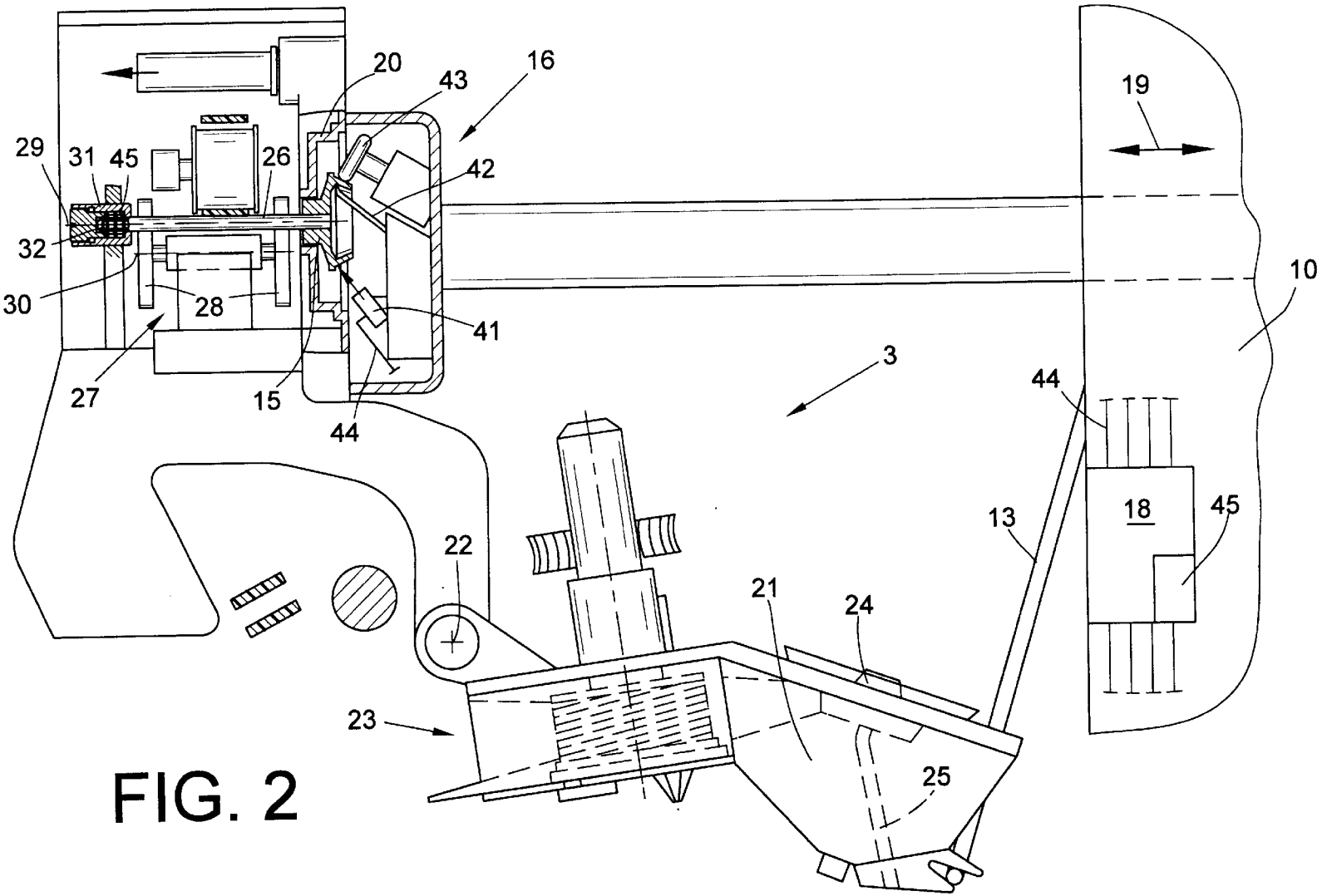
FIG. 2 is a more detailed partially sectioned side view of the open-end spinning device of one work station of the spinning machine of FIG. 1, which spinning device has been opened by the service unit in the course of checking the spinning rotor by means of a sensor device arranged at the cleaning head of the service unit.

FIG. 2 represents a situation wherein the service unit 10 is locked to a work station 2 of the open-end spinning machine, and the spinning device 3 has been opened by means of its unlocking lever 13. Thus, the cover housing 21 of the open-end spinning device 3 has been tilted toward the front around a pivot shaft 22.

The structural design of such a cover housing 21, with a sliver opening device 23, a sliver guide conduit (not represented), a sliver conduit plate 24 and a yarn draw-off tube 25, is known and therefore should not require further explanation.

The spinning rotor 15, which revolves at high rpm during the spinning process, is seated by its rotor shaft 26 in the bearing wedge formed between the two pairs of support disks or wheels of an axial thrust-free support disk bearing 27. In particular, the axes 30 of the pairs of support disks extend parallel with the axis 29 of the rotor shaft 26. For sake of illustration of the spinning device components, only the one pair of support disks 28 which, viewed from the direction of the service unit, is on the right, has been represented in FIG. 2.

The axial positioning of the rotor shaft 26 of the spinning rotor 15 in the bearing wedge of the support disk bearing 27 is achieved via a magnetic bearing 31, which acts on the end of the rotor shaft. Such a magnetic bearing 31 has been extensively described, for example in German Patent Publication DE 197 29 191.0.

Figure 3:
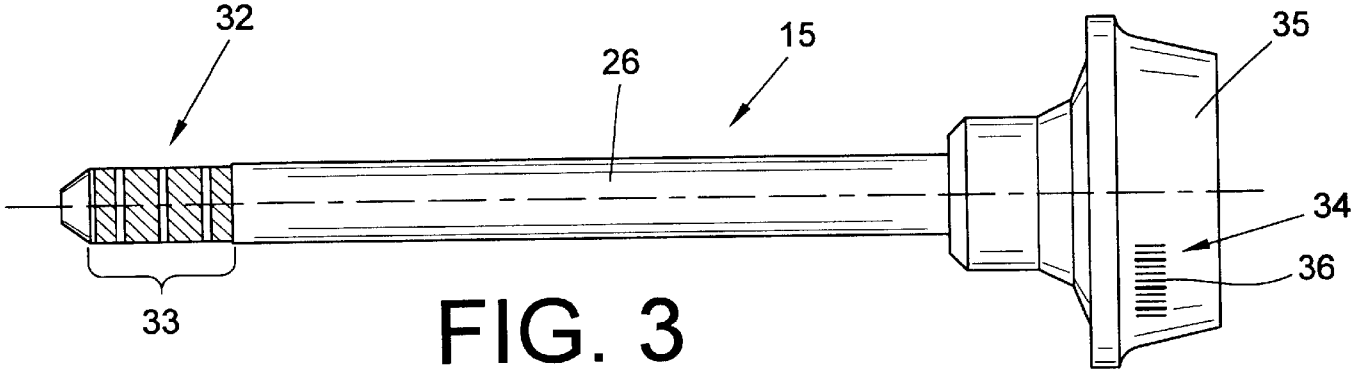
FIGS. 3 and 4 are side views of a spinning rotor and shaft showing different embodiments of an identification marker arranged on the spinning cup of the spinning rotor.
Figure 4:
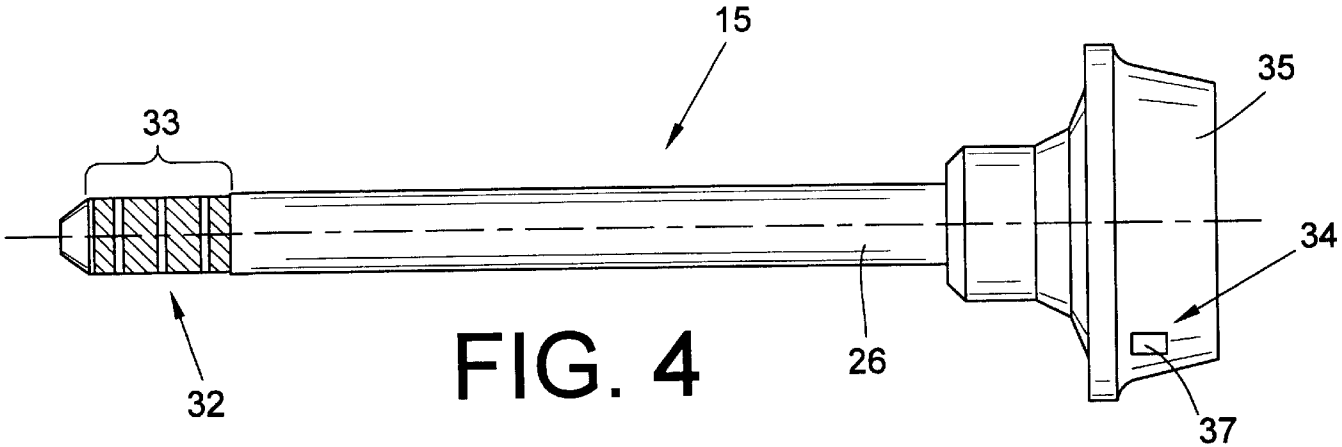

The magnetic bearing 31 has a stationary bearing component 45, which is fixed in place on the spinning housing and comprises two permanent magnet rings bordered by pole disks, and a rotating bearing component 32, which as represented in FIGS. 3 and 4, is formed by a bearing area 33 at the end of the rotor shaft 26.

The bearing area 33 at the end of the rotor shaft of the spinning rotor 15 is exactly matched in its structural layout to the bearing component 45 of the magnetic bearing 3 1. Therefore, correct and secure positioning of the spinning rotor 15 in the bearing wedge of an axial thrust-free support disk bearing is only assured, especially at high operating rpm, if the spinning rotor 15 has a bearing area 33 which is exactly matched to the stationary bearing component 45 of the magnetic bearing 31. In order to assure that in open-end spinning devices 3 with axial thrust-free support disk bearings and magnetic positioning of the spinning rotor only spinning rotors can be operated which are suited to this magnetic positioning because of their structural design, these spinning rotors 15 are marked in accordance with the present invention with an appropriate identification marker 34.

This identification marker 34 can either consist, as represented in FIG. 3, of a bar code 36 arranged in the area of the rotor cup 35 or, as represented in FIG. 4, of an electronic information carrier 37, for example a so-called transponder, or such other equivalent, substitute or otherwise appropriate means of identification.

Figure 5:
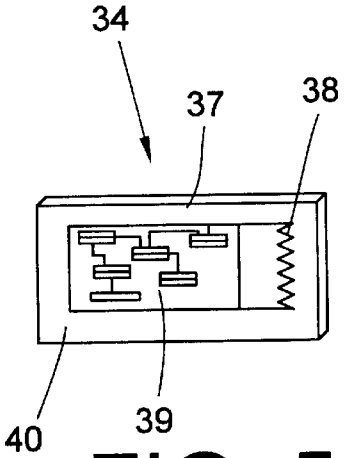
FIG. 5 is an elevational view of the electronic information carrier indicated in FIG. 4 in an enlarged scale.

Such an electronic information carrier 37, shown in an enlarged scale in FIG. 5, can be designed in the manner of a small chip card, for example. The electronic information carrier 37 has a transmission and receiving coil 38, as well as an integrated circuit 39. In this case, the transmission and receiving coil 38 and the integrated circuit are preferably embedded in an insulating layer 40, for example glass or the like. This insulating layer 40 constitutes a protective sheath for the relatively sensitive electronic device.

The electronic information carriers 37 are passive per se, i.e. they do not have their own energy source. The electronic information carriers 37 are only activated when they come into the range of an electromagnetic force field radiated by a sensor device 41. In this case an inductive energy and signal transmission takes place via a transmitting device and a receiving coil of the sensor device 41 and the transmission and receiving coil 38 of the electronic information carrier 37.

In comparison with optical identification markers, such as for example bar codes or the like, the previously described electronic information carriers have the great advantage that they are to a large degree insensitive to exterior influences, such as dust, fiber fluff, and the like, and are therefore very well suited for use in textile mills in particular.

The functioning of the device may thus be understood. In open-end rotor spinning machines 1, it has been long customary because of the high rpm of the spinning means to piece the yarn ends at the open-end spinning devices 3 by machines, i.e. by means of a service unit, not only for a new start-up of the spinning machine, for example following a batch change, but also after a yarn break.

For piecing for a new start-up of the machine, the service unit 10 is locked to the respective work station 2 and initially opens the open-end spinning device 3 by means of its unlocking lever 13. Thereafter a cleaning head 16 is placed on the spinning housing 20 and the spinning cup 35 of the spinning rotor 15 is cleaned. It is known that for this purpose the cleaning head 16 has a scraper 42, which can be extended into the interior of the rotor, and a rotor drive device 43.

In addition, a sensor device 41 is arranged in or on the cleaning head 16 and is connected via a signal line 44 to the control device 18 of the service unit 10.

Depending on the type of design of the identification markers 34 arranged on the spinning rotors 15, the sensor device 41 can be embodied as an optical sensor device, for example as a scanner, as an electronic transmitting and receiving device, as an inductive coil, etc. In the course of cleaning the spinning rotor 15, the sensor device 41 checks the identification marker 34 arranged on the rotor cup 35. In the case of an electronic information marker 34, for example, the data detected by the sensor device 41 are processed in the control device 18 of the service unit 10, i.e. such detected data are compared with data which have been filed in a memory unit 45 connected to the control device 18.

The further progress of the piecing process depends on the result of this comparison. If, for example, the sensor device 41 cannot detect any identification marker 34 on the rotor cup 35, or if the data on the identification marker 34 do not correspond with the data filed in the memory unit 45, the piecing attempt is immediately stopped by the control device 18 of the service unit 10, and a warning signal, e.g., a red warning light, is activated at the respective spinning station.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for operating an open-end spinning machine having a plurality of open-end spinning devices and a service unit for automatically servicing the spinning devices, the service unit having a device for piecing yarns being spun at the spinning devices and a control device for controlling actuation of the piecing device, each of the open-end spinning devices having a spinning rotor, a rotor shaft affixed to the rotor, an axial thrust-free support disk bearing forming a bearing wedge in which the rotor shaft is supported, and a magnetic bearing for positioning the rotor shaft, the method comprising:

providing an identification marker on each spinning rotor, providing the service unit with a sensor device connected with the control device of the service unit for detecting the identification markers of the spinning rotors, detecting the identification markers by the sensor device, and actuating a yarn piecing operation by the service unit only upon detection of an identification marker identifying the spinning rotor to be compatible with the associated spinning device.

2. The method in accordance with claim 1, wherein the identification marker comprises a security marking designating the spinning rotor as safe for use with the associated spinning device and the actuating step comprises preventing a yarn piecing operation by the service unit in the absence of detection of the security marking to prevent risk of damage or injury from use of improper spinning rotors.

3. The method in accordance with claim 1, wherein each identification marker comprises an information carrier provided with spinning rotor data and the control device of the service unit includes a memory unit for storing reference data, the method further comprising reading the spinning rotor data from an information carrier and comparing the data contained on the information carrier in the control device of the service unit with reference data stored in the memory unit.

4. An open-end spinning machine having a plurality of open-end spinning devices and a service unit for automatically servicing the spinning devices, the service unit having a device for piecing yarns being spun at the spinning devices and a control device for controlling actuation of the piecing device, each of the open-end spinning devices having a spinning rotor, a rotor shaft affixed to the rotor, an axial thrust-free support disk bearing forming a bearing wedge in which the rotor shaft is supported, and a magnetic bearing for positioning the rotor shaft, each spinning rotor having an identification marker, the service unit having a sensor device connected with the control device of the service unit for detecting the identification markers of the spinning rotors, and the control device being operative for actuating a yarn piecing operation by the service unit only upon detection of an identification marker identifying the spinning rotor to be compatible with the associated spinning device.

5. The open end spinning device in accordance with claim 4 wherein the identification marker comprises a security marking designating the spinning rotor as safe for use with the associated spinning device, and the control device being operative for preventing a yam piecing operation by the service unit in the absence of detection of the security marking to prevent risk of damage or injury from use of improper spinning rotors.

6. The open-end spinning device in accordance with claim 4, wherein the identification marker is arranged in the area of the rotor cup of each spinning rotor.

7. The open-end spinning device in accordance with claim 4, wherein the sensor device is arranged on a cleaning head of the service unit.

8. The open-end spinning device in accordance with claim 4, wherein the identification marker comprises an electronic information carrier.

9. The open-end spinning device in accordance with claim 8, wherein the electronic information carrier comprises a transponder.

10. The open-end spinning device in accordance with claim 4, wherein the identification marker comprises an optical sign.

11. The open-end spinning device in accordance with claim 10, wherein the optical sign comprises a bar code.

* * * * *